US005554320A

United States Patent [19]

Yianakopoulos

[11] Patent Number: 5,554,320

[45] **Date of Patent: * Sep. 10, 1996**

[54] LIQUID CLEANING COMPOSITIONS

[76] Inventor: Georges Yianakopoulos, Rue Gros Gland, 30, 4000, Liege, Belgium

[ * ] Notice: The term of this patent shall not extend beyond the expiration date of Pat. No. 5,462,697.

[21] Appl. No.: 311,753

[22] Filed: Sep. 23, 1994

Related U.S. Application Data

[63] Continuation-in-part of Ser. No. 155,315, Nov. 22, 1993, Pat. No. 5,462,697.

[51] Int. Cl.[6] ..... C23F 11/14; C23F 11/167

[52] U.S. Cl. ..... 252/389.23; 134/3; 134/28; 252/390; 252/392; 252/312; 510/417; 510/402; 510/238; 510/239; 510/264; 510/504; 510/335

[58] Field of Search ..... 252/528, 136, 252/390, 392, 394, 389.23; 134/3, 28

[56] References Cited

U.S. PATENT DOCUMENTS

| | | | |
|---|---|---|---|
| 2,199,712 | 5/1940 | Neilson | 134/3 |
| 2,676,104 | 4/1954 | Blake et al. | 514/143 |
| 3,630,932 | 12/1971 | Tedeschi et al. | 134/3 |
| 4,126,586 | 11/1978 | Curtis et al. | 252/524 |
| 4,199,464 | 4/1980 | Cambre | 252/91 |
| 4,199,465 | 4/1980 | Rodriguez | 252/91 |
| 4,589,988 | 5/1986 | Rieck et al. | 252/8.8 |
| 4,592,856 | 6/1986 | Kobayashi et al. | 252/162 |
| 4,686,002 | 8/1987 | Tasset | 216/100 |
| 4,835,660 | 5/1989 | Dapo | 525/340 |
| 5,039,441 | 8/1991 | Thomas et al. | 252/142 |
| 5,075,026 | 12/1991 | Loth et al. | 252/122 |
| 5,076,954 | 12/1991 | Loth et al. | 252/122 |
| 5,078,913 | 1/1992 | Bennett | 525/340 |
| 5,082,584 | 1/1992 | Loth et al. | 252/122 |
| 5,108,643 | 4/1992 | Loth et al. | 252/174 |
| 5,116,605 | 5/1992 | Alt | 424/70 |
| 5,137,982 | 8/1992 | Bennett | 525/340 |
| 5,192,460 | 3/1993 | Thomas et al. | 252/142 |
| 5,415,813 | 5/1995 | Misselyni et al. | 252/547 |
| 5,462,697 | 10/1995 | Yianakopoulos | 252/528 |

OTHER PUBLICATIONS

Derwent Abstract 92–051973 for JP 3–294204 (Dec. 25, 1991).

*Primary Examiner*—Sharon Gibson
*Assistant Examiner*—Valerie Fee

[57] ABSTRACT

Microemulsion for all purpose hard surface cleaning compositions which contain an anticorrosion system designed to protect acid sensitive surfaces from attack by acidic materials.

3 Claims, No Drawings

LIQUID CLEANING COMPOSITIONS

RELATED APPLICATION

This application is a continuation in part application of U.S. Ser. No. 8/155,315, filed Nov. 22, 1993, now U.S. Pat. No. 5,462,697.

FIELD OF THE INVENTION

This invention relates to an improved cleaning composition in the form of a microemulsion designed in particular for cleaning hard surfaces having an improved anticorrosion system to protect cast iron enamels from corrosion as well as to an all purpose hard surface cleaning composition.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

Hard surface cleaners, such as bathroom cleaners and scouring cleansers, have been known for many years. Scouring cleansers normally include a soap or synthetic organic detergent or other surface active agent, and an abrasive. Such products can scratch relatively soft surfaces and can eventually cause them to appear dull. Also, they are sometimes ineffective to remove lime scale (usually encrusted calcium and magnesium carbonate) in normal use. Because lime scale can be removed by chemical reactions with acidic media many acidic cleaners have been produced, which have met with various degrees of acceptance. In some instances such cleaners have been failures because the acid employed was too strong and damaged the surfaces being cleaned. At other times, the acidic component of the cleaner reacted objectionably with other components of the product, adversely affecting the detergent or perfume, for example. Some cleaners required rinsing afterward to avoid leaving objectionable deposits on the cleaned surfaces.

As a result of research performed in efforts to overcome the mentioned disadvantages there have recently been manufactured improved liquid cleaning compositions in stable microemulsion form which are effective to remove soap scum, lime scale and greasy soils from hard surfaces, such as bathroom surfaces, and which do not require rinsing after use. Such products are described in U.S. Pat. No. 5,076,954 for Stable Microemulsion Cleaning Composition, which is hereby incorporated by reference.

In particular, Example 3 of that application discloses an acidic, clear, oil-in-water microemulsion which is therein described as being successfully employed to clean shower wall tiles of lime scale and soap scum that had adhered to them. Such cleaning was effected by applying the cleaner to the walls, followed by wiping or minimal rinsing, after which the walls were allowed to dry to a good shine.

The described compositions of U.S. Pat. No. 5,076,954 are effective in removing lime scale and soap scum from hard surfaces, and is easy to use, but it has been found that its mixture of acidic agents (succinic, glutaric and adipic acids) could damage the surfaces of some hard fixtures, such as those of materials which are not acid resistant.

In order to overcome the foregoing disadvantage of the prior art all-purpose liquid, U.S. Pat. No. 4,01 7,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase. In view of the extremely fine particle size of the dispersed oil phase particles, microemulsions are transparent to light and are clear and usually highly stable against phase separation.

This invention relates to a cleaner for hard surfaces, such as bathtubs, sinks, tiles, porcelain and enamelware, which removes soap scum, lime scale and grease from such surfaces without harming them. More particularly, the invention relates to an acidic microemulsion or acidic all purpose cleaning composition that can be sprayed onto the surface to be cleaned, and wiped off without usual rinsing, and still will leave the cleaned surface bright and shiny. The invention also relates to an all purpose hard surface cleaning composition. One of such materials is an enamel that has been extensively employed in Europe as a coating for bathtubs, herein referred to as European enamel, zirconium white enamel or zirconium white powder enamel, which has the advantage of being resistant to detergents, which makes it suitable for use on tubs, sinks, shower tiles and bathroom enamelware. However, such enamel is sensitive to acids and is severely damaged by use of the microemulsion acidic cleaner based on the three organic carboxylic acids, which was mentioned previously. That problem has been solved by the present invention which employs an anticorrosion system of a nitrogen containing organic compound and phosphoric acid in the cleaner with the organic acids, and rather than exacerbating the problem, they prevent damage to such European enamel surfaces by such organic acids. Thus, the present invention allows the cleaning by the invented compositions of European enamel surfaces, as well as any other acid resistant surfaces of bathtubs, and other bathroom surfaces. However, the product should not be used on materials that are especially susceptible to attack by acidic media, such as marble.

In accordance with the present invention an acidic aqueous liquid cleaner for bathtubs and other hard surfaced items which are acid resistant or are of zirconium white enamel, which cleaner is of a pH in the range of 1 to 4, and which removes lime scale, soap scum and greasy soil from surfaces of such items without damaging such surfaces, comprises: a detersive proportion of synthetic organic detergent, which is capable of removing greasy soil from such surfaces; a lime scale and soap scum removing proportion of organic acid(s) having 2 to 10 carbon atoms therein, which group of acids excludes oxalic and malonic acids, an anticorrosion system, with the proportions being such as to prevent damage to zirconium white enamel surfaces of items to be cleaned by the organic acid(s) when the cleaner is employed to clean such items.

U.S. Pat. No. 5,082,584 discloses a microemulsion composition having an anionic surfactant, a cosurfactant, nonionic surfactant, perfume and water; however, these compositions do not possess the anticorrosion effect and the improved interfacial tension properties as exhibited by the compositions of the instant invention.

U.S. Pat. No. 5,192,460 discloses an acidic microemulsion which contains an anticorrosion system comprising a mixture of phosphoric acid aminotris-(methylenephosphoric acid).

A major problem in cleaning of enamel hard surface is that enamel surfaces containing high levels of Al and Zr are attached by the acid components of the microemulsion composition thereby causing corrosion of the enamel surface on the hard surface, it is desirably in the cleaning of hard surface to be able to minimize this corrosion. The unique and novel microemulsion and all purpose hard surface cleaning compositions of the instant invention have incorporated therein an anticorrosion system which helps minimize the corrosion on the enamel surface being cleaned.

SUMMARY OF THE INVENTION

The present invention provides an improved, clear, liquid cleaning composition having improved interfacial tension which improves cleaning hard surface in the form of a microemulsion which is suitable for cleaning hard surfaces such as enamel, plastic, vitreous and metal surfaces having a shiny finish or in the form of an all purpose hard surface cleaning composition. More particularly, the improved cleaning microemulsion or all purpose hard surface compositions exhibit good anticorrosion properties and exhibit improved cleaning due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant microemulsion or all purpose hard surface cleaning compositions exhibit improved anticorrosion properties in that the instant compositions impede or decrease the acidic attack on surfaces that have been cleaned with the instant compositions as compared to surfaces which are cleaned with a commercial microemulsion composition or commercial all purpose hard surface cleaning composition.

In one aspect, the invention generally provides a stable, clear microemulsion cleaning composition especially effective in the removal of oily and greasy oil, which is in the form of a substantially dilute oil-in-water microemulsion having an aqueous phase and an oil phase; The o/w microemulsion includes, on a weight basis:

(a) about 0. 1% to 20% by of an anionic surfactant;

(b) 0.1% to about 15% of a water-mixable nonionic surfactant;

(c) about 0.25% to about 7.0% of an anticorrosion system;

(d) 1% to 10% of at least one organic acid cosurfactant;

(e) 0 to 15% of magnesium sulfate heptahydrate;

(f) 0.4% to 10.0% of a perfume or water insoluble hydrocarbon; and (g) 10% to 85% of water, said proportions being based upon the total weight of the composition. The dispersed oil phase of the o/w microemulsion is composed essentially of the water-immiscible or hardly water-soluble perfume.

Quite surprisingly although the perfume is not, per se, a solvent for greasy or oily soil,—even though some perfumes may, in fact, contain as much as about 80% of terpenes which are known as good grease solvents—the inventive compositions in dilute form have the capacity to solubilize up to about 10 times or more of the weight of the perfume of oily and greasy soil, which is removed or loosened from the hard surface by virtue of the action of the anionic surfactant, said soil being taken up into the oil phase of the o/w microemulsion.

In second aspect, the invention generally provides highly concentration microemulsion compositions in the form of either an oil-in-water (o/w) microemulsion or a water-in-oil (w/o) microemulsion which when diluted with additional water before use can form dilute o/w microemulsion compositions.

In a third aspect, the acidic all purpose hard surface cleaning compositions of the instant invention comprise approximately by weight:

(a) 0.1% to 30.0% of at least one surfactant selected from the group consisting of nonionic surfactants and anionic surfactants;

(b) 0.25% to 7.0% of an anticorrosion system;

(c) 1% to 10% of at least one organic acid cosurfactant;

(d) 0 to 15% of magnesium sulfate heptahydrate;

(e) 0.05% to 0.3% of a perfume or a water insoluble hydrocarbon; and (f) the balance being water.

DETAILED DESCRIPTION OF THE INVENTION

One form of the present invention relates to a stable microemulsion composition approximately by weight: 0.1% to 20% of an anionic surfactant, 0.1% to 15.0% of a nonionic surfactant, 0.25% to 7.0% of an anticorrosion agent, 0.4% to 10% of a water insoluble hydrocarbon or a perfume, 1% to 10% of at least one organic acid cosurfactant; and the balance being water.

The microemulsion compositions of the present invention are in the form of an oil-in-water microemulsion in the first aspect or after dilution with water in the second aspect, with the essential ingredients being water, anionic surfactant, nonionic surfactant, anticorrosion system, and a hydrocarbon or perfume.

According to the present invention, the role of the hydrocarbon is provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of about 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved. The cosmetic properties of the ultimate cleaning composition are improved: the compositions are both clear (as a consequence of the formation of a microemulsion) and highly fragranced (as a consequence of the perfume level).

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc. The instant compositions show a marked improvement in ecotoxocity as compared to existing commercial products.

The hydrocarbon such as a perfume is present in the dilute o/w microemulsion in an amount of from about 0.4% to about 10% by weight, preferably from about 0.4% to about 3.0% by weight, especially preferably from about 0.5% to about 2.0% by weight, such as about weight percent. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, With some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

Thus, for a typical formulation of a diluted o/w microemulsion according to this invention a 20 milliliter sample of o/w microemulsion containing 1% by weight of perfume will be able to solubilize, for example, up to about 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent. In other words, it is an essential feature of the compositions of this invention that grease removal is a function of the result of the microemulsion, per se, and not of the presence or absence in the microemulsion of a "greasy soil removal" type of solvent.

In place of the perfume one can employ a water insoluble paraffin or isoparaffin having about 6 to about 18 carbon at a concentration of about 0.4 to about 8.0 wt. percent, more preferably 0.4 to 3.0 wt. %.

Regarding the anionic detergent present in the o/w microemulsions any of the conventionally used water-soluble anionic detergents or mixtures of said anionic detergents and anionic detergents can be used in this invention. As used herein the term "anionic surfactant" is intended to refer to the class of anionic and mixed anionic-nonionic detergents providing detersive action.

Suitable water-soluble non-soap, anionic detergents include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such detergents are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic detergents are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic detergents are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of suitones and alkene sulfonic acids which is then treated to convert the suitones to sulfonates. Preferred olefin sulfonates contain from 14 to 16 carbon atoms in the R alkyl group and are obtained by sulfonating an 2 olefin.

Other examples of suitable anionic sulfonate detergents are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate detergents are the $C_8$–$C_{18}$ alkyl sulfate salts and the $C_8$–$C_{18}$ alkyl sulfate salts and the $C_8$–$C_{18}$ alkyl ether polyethenoxy sulfate salts having the formula $R(OC_2H_4)n\ OSO_3M$ wherein n is 1 to 12, preferably 1 to 5, and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule .also are suitable for use in the inventive compositions. These detergents can be prepared by reacting an alkyl phenol with 2 to 6 moles of ethylene oxide and sulfating and neutralizing the resultant ethoxylated alkylphenol.

Other suitable anionic detergents are the $C_9$–$C_{15}$ alkyl ether polyethenoxyl carboxylates having the structural formula $R(OC_2H_4)_nOX$ COOH wherein n is a number from 4 to 12, preferably 5 to 10 and X is selected from the group consisting of $CH_2$, $(C(O)R_1$ and $C(O)$

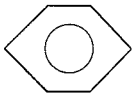

wherein $R_1$ is a $C_1$–$C_3$ alkylene group. Preferred compounds include $C_9$–$C_{11}$ alkyl ether polyethenoxy (7–9) C(O) $CH_2CH_2COOH$, $C_{13}$–$C_{15}$ alkyl ether polyethenoxy (7–9) C(O)

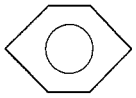

COOH and $C_{10}$–$C_{12}$ alkyl ether polyethenoxy (5–7) CH2COOH. These compounds may be prepared by considering ethylene oxide with appropriate alkanol and reacting this reaction product with chloracetic acid to make the ether carboxylic acids as shown in U.S. Pat. No. 3,741,911 or with succinic anhydride or phtalic anhydride. Obviously, these anionic detergents will be present either in acid form or salt form depending upon the pH of the final composition, with salt forming cation being the same as for the other anionic detergents.

Of the foregoing non-soap anionic detergents, the preferred detergents are the $C_9$–$C_{15}$ linear alkylbenzene sulfonates and the $C_{13}$–$C_{17}$ paraffin or alkane sulfonates. Particularly, preferred compounds are sodium $C_{10}$–$C_{13}$ alkylbenzene sulfonate and sodium $C_{13}$–$C_{17}$ alkane sulfonate.

Generally, the proportion of the nonsoap-anionic detergent in the microemulsion composition will be in the range of 0.1% to 20.0%, preferably from 1% to 7%, by weight of the dilute o/w microemulsion composition.

The water soluble nonionic surfactants are utilized in the microemulsion compositions at a concentration of about 0.1 to 15.0 wt. %, more preferably 0.5 to 10 wt. % are commercially well known and include the primary aliphatic alcohol ethoxylates, secondary aliphatic alcohol ethoxylates, alkylphenol ethoxylates and ethylene-oxide-propylene oxide condensates on primary alkanols, such as Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, laurylmyristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type of $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-C 10–C20 alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents which are less preferred are marketed under the trade name "Pluronics". The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactant will be in liquid form and satisfactory surfactants are available Plurafac LF400 from BASF.

The anticorrosion system of the instant invention is a mixture of phosphoric acid and a nitrogen containing organic compound which is characterized by the formula:

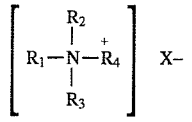

wherein $R_1$ is a methyl group and $R_2$, $R_3$ and $R_4$ are independently selected from the group consisting of methyl, ethyl, $CH_2CH_2Y$ and $CH_2CH_2CH_2Y$, wherein Y is selected from the group consisting of Cl, Br, $CO_2H$, $(CH_2O)n$ OH wherein n=1 to 10 and OH, and $X^-$ is selected from the group consisting of Cl, Br, and

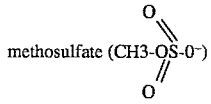

Preferred anticorrosion agents are B-hydroxyethyltrimethyl ammonium chloride (choline chloride), B-chloroethyltrimethyl ammonium chloride, and tri(B-hydroxyethyl) methyl ammonium methosulfate (Stephan Quat), wherein the choline chloride is preferred. It is theorized that the positively charged anticorrosion agent is electrostatically bonded to the negatively charged groups on the enamel surface thereby preventing attack the negative charged surface of the enamel surfactant by the acidic compotents of the microemulsion composition. The concentration of the anticorrosion system in the instant composition is about 0.25 to about 7.0 wt. % and more preferably about 0.5 to about 5.5 wt. %, and most preferably 0.5% to 4.5% wherein the concentration of phosphoric acid is about 0.005 to about 2 wt. %, more preferably 0.075% to 1.0% and preferably 0.01% to 0.5% and the concentration of the nitrogen containing organic compound is about 0.25 to about 5.0 wt. %, more preferably about 0.5 to about 4.5 wt. %, most preferably 0.5% to 4.0%. Phosphoric acid is a tribasic acid and it may be partially neutralized. For example, it may be partially neutralized to monosodium phosphate, $NaH_2PO_4$, or monoammonium phosphate, $NH_4H_2PO_4$.

The instant invention is also related to an anticorrision solution which comprises approximately 0.005 to about 0.5 wt. % of phosphoric acid; about 0.5 to about 5.0 wt. %, more preferably 1.0 to 4.0 wt. % of the nitrogen containing organic compound and the balance being water, wherein the anticorrision solution does not contain any sodium chloride or Lecithin-Soya or soy oil which would be detrimental to the anticorrision protection afforded by the instant anticorrision solution. The anticorrision solution is applied to the acid sensitive sudace which is subsequently washed with an acidic microemulsion composition such as those exemplified in U.S. Pat. No. 5,192,460.

The acidic cosurfactant plays an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a miceliar solution (low concentration) or form an oil-in-water emulsion in the first aspect of the invention. With the cosurfactant added to this system, the interfacial tension at the interface between the emulsion droplets and aqueous phase is reduced to a very low value (never negative). This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized. Thus, the role of acidic cosurfactant in formation of a stable o/w microemulsion is to (a) decrease interfacial tension (2); and (b) modify the microemulsion structure and increase the number of possible configurations (3). Also, the cosurfactant will (c) decrease the rigidity.

The acidic cosurfactant is an aliphatic mono- di- or tri-carboxylic acid and mixtures thereof containing 2 to 10 carbon atoms, preferably 3 to 6 carbons in the molecule.

The mono- di- or tri-carboxylic acid cosurfactants are employed in the instant microemulsion compositions at a concentration of about 1 to 10 wt. %. The microemulsion compositions can be used as a cleaner for bathtubs and other hard surfaced items, which are acid resistant or are of zirconium white enamel thereby removing lime scale, soap scum and greasy soil from the surfaces of such items damaging such surfaces.

Representative members of the aliphatic carboxylic acids include $C_2$–$C_{10}$, more preferably $C_3$–$C_6$ alkyl and alkenyl monobasic acids and dibasic acids such as giutaric acid and mixtures of glutaric acid with adipic acid and succinic acid, as well as mixtures of the foregoing acids.

A mixture of adipic, glutaric and succinic acids is preferred. The ratio of acids in the foregoing mixture is not particularly critical and can be modified to provide the desired odor. Generally, to maximize water solubility of the acid mixture glutaric acid, the most water-soluble of these three saturated aliphatic dibasic acids, will be used as the major component. Generally, weight ratios of adipic acid: glutaric acid:succinic acid is 1–3:1–8:1–5, preferably 1–2:1–6:1–3, such as 1:1:1,1:2:1,2:2:1, 1:2:1.5, 1:2:2, 2:3:2, etc. can be used with equally good results.

Carboxylic and other acids, such as ascorbic acid, can be used but most of those which have been found to be usefully effective and which appear to remove soap scum and lime scale from bathroom fixture surfaces, while still not destabilizing the emulsion, are of 2 to 10 carbon atoms. Preferably such acids are of 3 to 8, 3 to 6 or 4 to 6 carbon atoms, and are carboxylic. They may be mono-, di- or polycarboxylic, of which the dicarboxylic acids are preferred. In the dicarboxylic acids group suberic, azelaic, sorbic and sebacic acids are of lower solubilities than the desired 1% or more, in water, and therefore they are not as useful in the present microemulsions as the other dibasic aliphatic fatty acids, which are preferably saturated and straight chained. Oxalic and malonic acids, although effective as pH reducing agents, are considered to be too strong for cleaning European enamel surfaces, and cleaners. Valeric acid tends to cause microemulsion phase separations and therefore is often avoided. Preferred dibasic acids are those of the middle portion of the 2 to 10 carbon atoms range, such as 4 to 8, and more preferably 4 to 6 carbon atoms, including succinic, glutaric, adipic and pimelic acids, especially the first three thereof, which fortunately are available commercially, and in mixtures. Such mixtures will be of proportions in the ranges of 0.8–4:0.8–10:1, or 1–3:1–6:1, e.g., 1:1:1 and 2:5:1, respectively. These and other operative organic acids, before or after being incorporated in the invented emulsions, may be partially neutralized to produce the desired pH of the microemulsion for greatest functional effectiveness, with safety.

Monobasic, tribasic and other polybasic acids of the same carbon atoms contents may also be employed instead of dibasic acids (both saturated and unsaturated), as may be hydroxycarboxylic acids. Such as often saturated straight chain acids but may be alkylenically unsaturated (often with a single double bond). Normally they will be aliphatic, rather than aromatic, but they may be cycloaliphatic. Such acids, which are useful in the invented compositions instead of the saturated dicarboxylic acids, unsaturated dicarboxylic acids, saturated tri- or higher carboxylic acids, unsaturated monocarboxylic acids, glycollic acid (alpha-hydroxyacetic acid), unsaturated tri- or higher carboxylic acids, alicyclic unsaturated dihydroxy acids, and polylower alkoxylated higher aliphatic acids. Any mixtures of such acids may also be employed. Representative of the various operative organic acids, in addition to the aforementioned specific dicarboxylic acids, are acetic acid, propionic acid, citric acid, malic acid, tartaric acid, acrylic acid, maleic acid, lactic acid, gluconic acid, ascorbic acid and "nonionic acid", such as $RO(C_2\text{-}H_4O)_{3-7}CH_2COOH$, wherein R is alkyl of 10 to 14 carbon atom, s, e.g., $C_{12}H_{25}O(C_2H_4O)_5CH_2COOH$, which is obtainable from Chemy as Akypotm RLM 45. Such acids may be employed singly or in any mixture with each other and with the previously described dibasic acids.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above.

The ability to formulate acidic products without builders which have anticorrosion properties is a feature of the present invention because the prior art o/w microemulsion formulations most usually are highly alkaline or highly built or both.

In addition to their excellent capacity for cleaning greasy and oily soils, the low pH o/w microemulsion formulations also exhibit excellent cleaning performance and removal of soap scum and lime scale in neat (undiluted) as well as in diluted usage.

The final essential ingredient in the inventive microemulsion compositions having improved interfacial tension properties is water. The proportion of water in the microemulsion compositions generally is in the range of 20% to 97%, preferably 70% to 97% by weight of the usual diluted o/w microemulsion composition.

As believed to have been made clear from the foregoing description, the dilute o/w microemulsion liquid all-purpose acidic cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds (i.e., primary anionic and nonionic detergents) dilutions up to about 50% will generally be well tolerated without causing phase separation, that is, the microemulsion state will be maintained.

However, even when diluted to a great extent, such as a 2- to 10-fold or more dilution, for example, the resulting compositions are still effective in cleaning greasy, oily and other types of soil. Furthermore, the presence of magnesium ions or other polyvalent ions, e.g., aluminum, as will be described in greater detail below further serves to boost cleaning performance of the primary detergents in dilute usage.

On the other hand, it is also within the scope of this invention to formulate highly concentrated microemulsions which will be diluted with additional water before use.

The present invention also relates to a stable concentrated microemulsion or acidic microemulsion composition comprising approximately by weight:

(a) 0.1% to 20% of an anionic surfactant;

(b) 0.25% to 7.0%% of an anticorrosion system;

(c) 1% to 10% of at least one dicarboxylic acid cosurfactant;

(d) 0.4% to 10% of a water insoluble hydrocarbon or perfume;

(e) 0.1% to 15.0% of a nonionic surfactant;

(f) 0 to 15% of magnesium sulfate heptahydrate; and (g) balance being water.

Such concentrated microemulsions can be diluted by mixing with up to about 20 times or more, preferably about 4 to about 10 times their weight of water to form o/w microemulsions similar to the diluted microemulsion compositions described above. While the degree of dilution is suitably chosen to yield an o/w microemulsion composition after dilution, it should be recognized that during the course of dilution both microemulsion and non-microemulsions may be successively encountered.

In addition to the above-described essential ingredients required for the formation of the microemulsion composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $Al^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic detergent. At higher concentrations of anionic detergent, the amount of multivalent salt will be in range of 0.5 to 1 equivalents per equivalent of anionic detergent.

The o/w microemulsion compositions can optionally include from 0% to 5%, preferably from 0.1% to 2.0% by weight of the composition of a $C8–C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The all-purpose liquid cleaning composition of this invention may, if desired, also contain other components either to provide additional effect or to make the product more attractive to the consumer. The following are mentioned by way of example: Colors or dyes in amounts of 0.01% to 0.5% by weight; bactericides in amounts of 0.01% to 1% by weight; preservatives or antioxidizing agents, such as formalin, 5-bromo-5-nitro-dioxan-1,3,5-chloro-2-methyl-4-isothaliazolin-3-one, 2,6-di-tertbutyl-p-cresol, etc., in amounts of 0.01% to 2% by weight; and pH adjusting agents, such as sulfuric acid or sodium hydroxide, as needed. The instant compositions must contain less than 1.0 wt. % of sodium chloride. Concentrations of sodium chloride in excess of 1 wt. % cause phase separation of the instant composition. Furthermore, if opaque compositions are desired, up to 4% by weight of an opacifier may be added.

In final form, the all-purpose liquids are clear oil-in-water microemulsions and exhibit stability at reduced and increased temperatures. More specifically, such compositions remain clear and stable in the range of 5° C. to 50° C., especially 10° C. to 43° C. Such compositions exhibit a pH in the acid range depending on intended end use. The liquids are readily pourable and exhibit a viscosity in the range of 6 to 60 milliPascal. second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid microemulsion compositions can be packaged under pressure in an aerosol container or in a pump-type sprayer for the so-called spray-and-wipe type of application.

The pH of the various preferred microemulsion cleaners is usually 1–5, preferably 1–4, and more preferably 1.5–3.5, e.g., 3. The water content of the microemulsions will usually be in the range of 75 to 90%, preferably 80 to 85%, and the adjuvant content will be from 0 to 5%, usually 1 to 3%. If the pH is not in the desired range it will usually be adjusted with either sodium hydroxide or other suitable alkaline agent, or a suitable acid, preferably as aqueous solutions thereof. Normally, the pH will be raised, not lowered, and if it has to be lowered more of the dicarboxylic acid mixture can be used, instead, and thereby such pH adjustment can be obviated.

The cleaners of the invention, in microemulsion form, are clear oil in water (o/w) emulsions and exhibit stability at room temperature and at elevated and reduced temperatures, from 10° to 50° C. They are readily pourable and exhibit a viscosity in the range of 1 or 2 to 150 or 200 centipoises, e.g., 5 to 40 cp., as may be desired, with the viscosity being controllable, in part, by addition to the formula of a thickener, such as lower alkyl cellulose, e.g., methyl cellulose, hydroxypropyl methyl cellulose, or a water soluble resin, e.g., polyacrylamide, polyvinyl alcohol. Any tendency of the product to foam objectionably can be counteracted by incorporating in the formula an appropriate foam controlling agent, such as a silicone, e.g., dimethyl silicone, in minor proportion.

The liquid cleaners of the invention can be manufactured by mere mixing of the various components thereof, with orders of additions not being critical. However, it is desirable for the various water soluble components to be mixed together, the oil soluble components to be mixed together, the oil soluble components to be mixed together in a separate operation, and the two mixes to be admixed, with the oil soluble portion being added to the water soluble portion (in the water) with stirring or other agitation. In some instances such procedure may be varied to prevent any undesirable reactions between components. For example, one would not add concentrated phosphoric acid directly to magnesium sulfate or to a dye, but such additions would be of aqueous solution preferably dilute solutions, of the components.

The cleaner may desirably packed in manually operated spray dispensing container, which are usually and preferably made of synthetic organic polymeric plastic material, such as polyethylene, polypropylene or polyvinyl chloride (PVC). Such containers also preferably include nylon or other non-reactive plastic closure, spray nozzle, dip tube and associated dispenser parts, and the resulting packaged cleaner is ideally suited for use in "spray and wipe" applications. However, in some instances, as when lime scale and soap scum deposits are heavy, the cleaner may be left on until it has dissolved or loosened the deposits, and may then be wiped off, or may be rinsed off, or multiple applications may be made, followed by multiple removals, until the deposits are gone. For spray applications the viscosity of the microemulsion (or ordinary emulsion, if that is used instead) will desirably be increased so that the liquid adheres to the surface to be cleaned, which is especially important when such surface is vertical, to prevent immediate run-off of the cleaner and consequent loss of effectiveness. Sometimes, the product may be formulated as an "aerosol spray type", so that its foam discharged from the aerosol container will adhere to the surface to be cleaned. At other times the aqueous medium may be such as to result in a gel or paste, which is deposited on the surface by hand application, preferably with a sponge or cloth, and is removed by a combination of rinsing and wiping, preferably with a sponge, after which it may be left to dry to a shine, or may be dried with a cloth. Of occurs, when feasible, the cleaned surface may be rinsed to remove all traces of acid from it.

The all purpose hard surface cleaners of the instant invention comprise approximately by weight:

(a) 1% to 30% of at least one surfactant selected from the group consisting of nonionic surfactants and anionic surfactants, wherein the nonionic surfactants and anionic surfactants are the same as those used in the previously described microemulsion compositions;

(b) 0.25% to 7.0% of an anticorrosion system which is the same as that used in the microemulsion composition;

(c) 1% to 10% of at least one organic acid, cosurfactant, wherein the cosurfactant is the same as that used in the microemulsion composition;

(d) 0 to 15% of magnesium sulfate heptahydrate;

(e) 0.5% to 0.3% of a perfume or a water insoluble hydrocarbon; and (f) the balance being water.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following microemulsion compositions in wt. % were prepared:

| | A | B |
|---|---|---|
| Paraffin sulfonate | 4.0 | 4.0 |
| Fatty alcohol $C_{13}$–$C_{15}$, 7EO 4PO (Plurafac LF400) | 3.0 | 3.0 |
| Perfume | 0.8 | 0.8 |
| K benzoate | 0.3 | 0.3 |
| choline chloride | 2.0 | 1.0 |
| Acid blend (Sokalan succinic/adipic/glutaric) | 5.0 | 5.0 |
| $H_3PO_4$ (85%) | 0.027 | 0.027 |
| NaOH (49%) | 0.3 | 0.3 |
| Water | Bal. | Bal. |
| pH | 3.0 | 3.0 |

Compositions A and B as well as a Commercial Ajax Bathroom Expert (control) Manufactured by Colgate-Palmolive Co. were tested for gloss value and gloss loss by reflectance measurements as well as being visually rated for any acidic attack by the composition on the surface being treated. The surface being treated was held in direct contact with the composition for 15 minutes. The surfaces cleaned by compositions A and B as well as Ajax Bathroom Expert were tested with a Rugosimeter. In all of the tests compositions A and B were equal to the control.

The microemulsion cleaner is made by dissolving the detergents in the water, after which the rest of the water soluble materials are added to the detergent solution, with stirring, except for the perfume and the pH adjusting agent (sodium hydroxide solution). The pH is adjusted to 3.0 and then the perfume is stirred into the aqueous solution, instantaneously generating the desired microemulsion, which is clear blue, and of a viscosity in the range of 2–20 cp. If the viscosity is too low or if it is considered desirable for it to be increased there is incorporated in the formula about 0.1 to 1%, e.g., 0.5%, of a suitable gum or resin, such as sodium carboxymethyl cellulose (CMC) or hydroxypropylmethyl cellulose, or polyacrylamide or polyvinyl alcohol, or a suitable mixture thereof.

The acid cleaner is packed in polyethylene squeeze bottles equipped with polypropylene spray nozzles, which are adjustable to closed, spray and stream positions. In use, the microemulsion is sprayed onto "bathtub ring" on a bathtub, which also includes lime scale, in addition to soap scum and greasy soil. The rate of application is about 5 mi. per 5 meters of ring (which is about 3 cm. wide). After application and a wait of about two minutes the ring is wiped off with a sponge and is sponged off with water. It is found that the greasy soil, soap scum, and even the lime scale, have been removed effectively. In those cases where the lime scale is particularly thick or adherent a second application may be desirable, but that is not considered to be the norm.

The tub surface may be rinsed because it is so easy to rinse a bathtub (or a shower) but such rinsing is not necessary. Sometimes dry wiping will be sufficient but if it is desired to remove any acidic residue the surface may be sponged with water or wiped with a wet cloth, but in such case it is not necessary to use more than ten times the weight of cleaner applied. In other words, the surface does not need to be thoroughly doused or rinsed with water, and it still will be clean and shiny (providing that it was originally shiny). In other uses of the cleaner it is employed to clean shower tiles, bathroom floor tiles, kitchen tiles, sinks and enamelware, generally, without harming the surfaces thereof. It is recognized that many of such surfaces are acid-resistant but a commercial product must be capable of being used without harm on even less resistant surfaces, such as European white enamel (often on a cast iron or sheet steel base), which is sometimes referred to as zirconium white powder enamel. It is a feature of the cleaner described above (and other cleaners of this invention) that they clean hard surfaces effectively, but they do contain ionizable acids and therefore should not be applied to acid-sensitive surfaces. Nevertheless, it has been found that they do not harm European white enamel bathtubs, in this example, which are seriously etched and dulled by cleaning with preparations exactly like that of this example except for the omission from them of the choline chloride phosphoric acid mixture.

EXAMPLE II

The following anticorrision solutions were made by simple mixing at 25° C.

| | A | B |
|---|---|---|
| Phosphoric acid | 0.027 | 0.054 |
| Choline chloride | 2.0 | 4.0 |
| Water | Balance | Balance |

The pH of the solutions A and B was adjusted at 3.2 Solutions A and B were compared to a commercial bathroom cleaning composition manufactured by Colgate-Palmolive Co. and having a pH of 3.5.

Solutions A and B were coated onto the acid sensitive surface to be treated. Subsequently the two surfaces treated with solutions A and B as well as an untreated surface (control) were soak treated for 15 minutes with a Commercial Ajax Bathroom Expert manufactured by Colgate-Palmolive Company. The two treated surfaces plus the control were tested for gloss value and gloss loss by reflectance measurements as well as being visually rated for any acidic attack by the Commercial Ajax Bathroom Expert being in contact for 15 minutes with the two treated surfaces and the untreated surface. The surfaces were treated with a Rugosimeter. The treated surfaces showed less acidic attack than the untreated surface.

B. The reflectance(reflectance angle=85° C.) of the tile was measured with a micro TRI gloss. The reflectance loss is was calculated by the following formula:

$$\text{reflectance loss} = \frac{[\text{refl. of untreated tile} - \text{refl. of treated tile}]}{\text{refl. of untreated tile}} \times 100$$

The roughness of the tile was measured with a rugosimeter, before and after treatment. The rugosimeter measures the following parameters of roughness: RA: it is the arithmetic mean of the departures of the profile from the mean line; Ry: the largest peak to valley heights within each cut-off length, Rti (the sampling length is divided in n shorter lengths) are determined. The Ry value is the largest Rti value of the assessment; Rz (DIN): it is the average of all the Rti values (peak to valley heights) in the assessment length.

Reflectance measurements:

| TILE | Reflectance | Reflectance Loss |
|---|---|---|
| Untreated | 91.8 | |
| Passivated by solution A | 89.5 | 2.5% |
| passivated by solution B | 91.5 | 0.32% |
| Passivated by commercial bathroom cleaner CP | 90.8 | 1.08% |
| Passivated by A, then attacked by sokalan | 80.4 | 12.41% |
| Passivated by B, then attacked by sokalan | 74.1 | 19% |
| Passivated by CP, then attacked by sokalan | 76.9 | 16.2% |
| Directly attacked by sokalan | 50.4 | 45.09% |

Roughness results:

| TILE | Ra | Ry | Rz (DIN) |
|---|---|---|---|
| Untreated | 0.10 | 0.5 | 0.4 |
| Passivated by solution A | 0.12 | 0.7 | 0.6 |
| passivated by solution B | 0.12 | 0.7 | 0.5 |
| Passivated by commercial bathroom cleaner CP | 0.08 | 0.5 | 0.4 |
| Passivated by A, then attacked by sokalan | 0.22 | 1.7 | 1.5 |
| Passivated by B, then attacked by sokalan | 0.26 | 1.7 | 1.4 |
| Passivated by CP, then attacked by sokalan | 0.18 | 2 | 1.4 |
| Directly attacked by sokalan | 0.24 | 2.4 | 2.2 |

The most representative parameter is the Rz(DIN). We could observe that the Rz values of passivated surface with the acidic solutions A, B, CP are very similar. By opposition after an acidic attack the differences of the Rz values are significant.

The invention which is the subject of this application has been described with respect to illustrations and preferred embodiments thereof but is not to be limited to them because one of ordinary skill in the art, with the benefit of applicants' specification and teachings before him or her, will be able to utilize substitutes and equivalents without departing from the invention.

What is claimed is:

1. An acidic anticorrosion solution which comprises approximately by weight:

(a) 0.1 to 0.5% of phosphoric acid;

(b) 0.5% to 4.0% of a nitrogen containing organic compound having the formula:

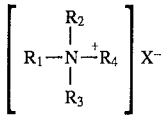

wherein $R_1$ is a methyl group and $R_2$, $R_3$, and $R_4$ are independently selected from the group consisting of $CH_3$, $C_2H_5$, $CH_2CH_2Y$ and $CH_2CH_2CH_2Y$, wherein Y is selected from the group consisting of Cl, Br, $CO_2H$, $(CH_2O)_nOH$, wherein n is 1 to 10 and OH, and $X^-$ is selected from the group consisting of Cl, Br, and methosulfate; and (c) the balance being water, wherein the anticorrosion solution does not contain any sodium chloride and said anticorrosion solution, when coated on an acid sensitive enamel surface, protects said acid sensitive enamel surface from corrosion.

2. The solution according to claim 1, wherein the concentration of the nitrogen containing organic compound is about 1.0 wt. % to about 4.0 wt. %.

3. The solution according to claim 1, wherein said nitrogen containing organic compound is choline chloride.

* * * * *